United States Patent [19]

Tylko

[11] 4,154,972

[45] May 15, 1979

[54] APPARATUS AND PROCEDURE FOR REDUCTION OF METAL OXIDES

[75] Inventor: Jozef K. Tylko, Faringdon, England

[73] Assignee: Tetronics Research and Development Company Limited, Faringdon, England

[21] Appl. No.: 826,697

[22] Filed: Aug. 22, 1977

[30] Foreign Application Priority Data

Aug. 27, 1976 [GB] United Kingdom ..... 35827/76

[51] Int. Cl.[2] ..... H05H 1/00

[52] U.S. Cl. ..... 13/2 P

[58] Field of Search ..... 13/1, 2, 2 P, 9 R

[56] References Cited

U.S. PATENT DOCUMENTS

Re. 28,570 10/1975 Tylko ..... 13/9 R

*Primary Examiner*—R. N. Envall, Jr.

*Attorney, Agent, or Firm*—Dennison, Dennison, Meserole & Pollack

[57] ABSTRACT

In a plasma reactor for reducing stable oxides, particularly alumina, oxide and carbon in particle form are allowed to descend through an upper plasma zone in which there is a precessive plasma column, into a lower collection zone, which has one or more gas outlets leading from a central region of its floor and a peripheral collection trough. The precessive plasma column imparts a rotational movement to descending particles so that solid or liquid droplets are separated from evolved carbon monoxide in the collection zone in the manner of a cyclone separator. High tension electrodes and/or liquid metal sprays may be provided to assist coalescence of fine droplets in the collection zone.

5 Claims, 11 Drawing Figures

APPARATUS AND PROCEDURE FOR REDUCTION OF METAL OXIDES

Figure 1:
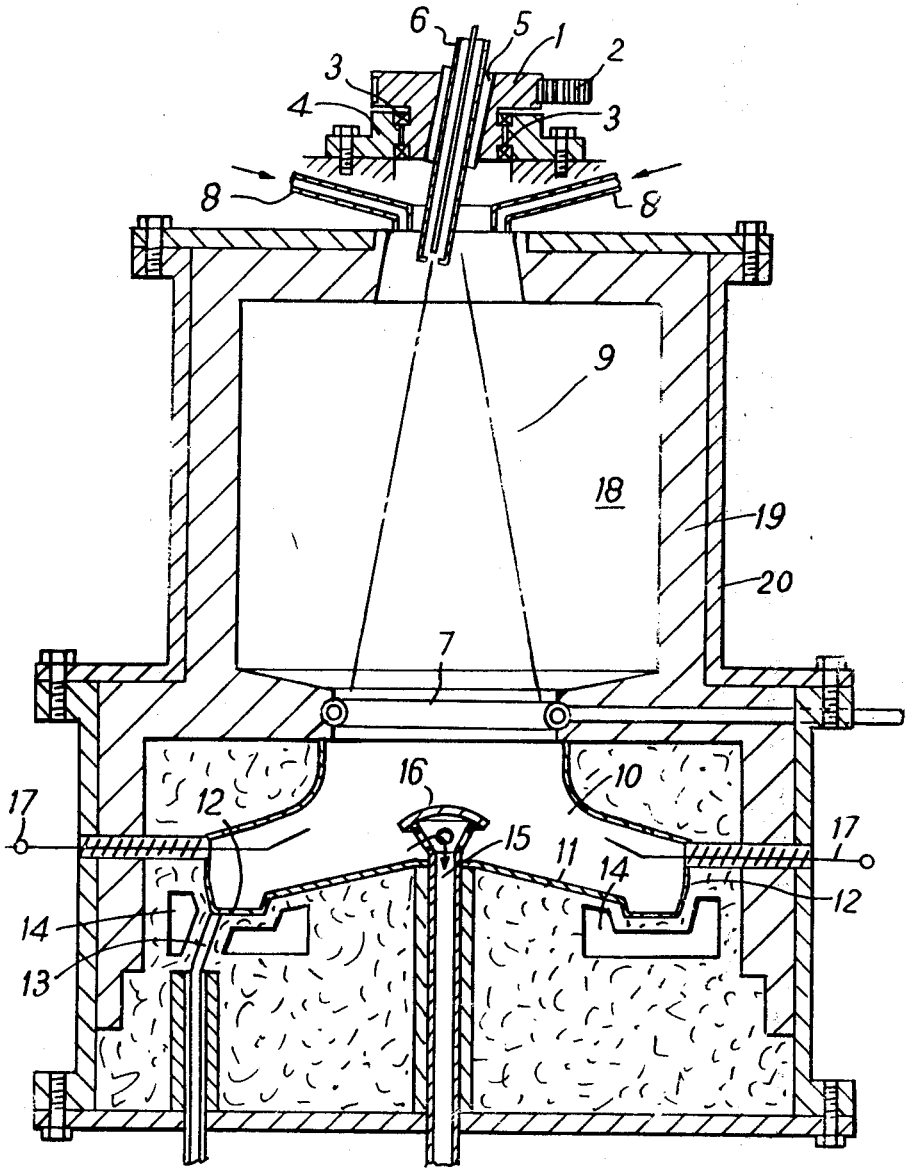

The present invention relates to the carbothermal reduction of oxides and in particular, but not exclusively, to the reduction of oxides which are characterised by a high energy of formation, such as the oxides of aluminium, silicon, calcium and magnesium.

It is believed to be possible under appropriate conditions to reduce the oxides of aluminium, calcium and magnesium by reaction with carbon or carbon-bearing materials, such as hydrocarbons, to yield the free metal and carbon monoxide. However there appears to be some form of reverse reaction between the metal and carbon monoxide in cooling down the reaction products from the reaction temperature. In most other carbothermal processes for the reduction of oxides of other elements such reverse reactions do not constitute a major difficulty.

In attempts to produce aluminium by carbothermal reduction of purified alumina, great difficulties are experienced as a result of the formation of aluminium carbide and the stable aluminium oxycarbide $Al_4O_4C$, as well as from the formation of volatile aluminium suboxide, $Al_2O$.

Although equilibrium diagrams for the system $Al_2O_3$—C are available and certain broad predictions can be made therefrom, there is relatively little reliable data.

Whilst many ingenious proposals have been put forward for the production of aluminium by first producing a highly alloyed aluminium by a direct carbothermal reduction, followed by a recovery of aluminium metal from such alloy, none of these proposals have so far been commercially competitive with the conventional Hall-Heroult process for the production of aluminium by electrolytic reduction of alumina in a molten cryolite bath.

The most apparently realistic process for the production of aluminium of acceptable purity by carbothermic reduction of alumina is described in U.S. Pat. No. 2,974,032, which appreciates the complexity of the interactions between alumina and carbon and in particular the complexity of the secondary reactions. The United States Patent teaches how to avoid the formation of aluminium oxycarbide by performing the reaction in an electric arc at a temperature, stated to be in the range of 2400–2500° C., which results in the production of a mixture of aluminium and aluminium carbide, from which aluminium is recovered. The apparent drawback to the process is the necessarily high consumption of the expensive graphite electrodes, required to withstand the thermal shock of the arc process. The cost of such graphite electrodes is of an entirely different order from the consumable petroleum coke electrodes employed in the conventional electrolytic process.

Furthermore, a considerable fuming will take place at the stated temperatures with subsequent loss of product and/or need for recycling of the fumes.

In our U.S. Pat. No. 3,783,167 we have already described a procedure by which particulate material can be raised to a very high temperature by feeding it into a column of plasma generated in a plasma arc reactor in a zone extending between one or more plasma sources, orbiting around a vertical axis, and a stationary ring-shaped electrode arranged below said source or sources of plasma. In our said U.S. patent we have described the production of aluminium from alumina by feeding alumina in particulate form into an upper region of the reactor and reacting the alumina with a carbon-bearing material during its descent, the produced aluminium being collected in the lowermost part of the reactor.

It is an object of the present invention to provide an improved procedure and improved apparatus for the carbothermal reduction of oxides (including wholly or partially hydrated oxides) by means of a plasma reactor.

The particular feature of the present invention is the rapid separation of the solid or liquid effluents of the plasma column from the gaseous effluents so as to reduce the tendency to reverse reaction between the solid or liquid effluents and the carbon monoxide resulting from the carbothermal reduction of the oxide. By reason of the mode of the generation of the plasma column, an angular acceleration about the vertical axis of the reactor is imparted to all solid or liquid particles entrained in the plasma column so that such particles, on leaving the tail flame region below the annular stationary electrode, tend to move towards the outer periphery of the reactor body. In order to separate the carbon monoxide from the solid or liquid phases and to reduce the concentration of carbon monoxide in the reactor, a gas outlet is provided on the axis of the reactor at the bottom end thereof. The collector for deposited solids and/or liquids thus preferably takes the form of a ring-shaped trough at or close to the peripheral lining of the reactor.

In place of a single gas outlet on the reactor axis it may be more convenient in a large reactor to provide a plurality of outlets symmetrically arranged about the axis (but well spaced from the surrounding peripheral lining).

The procedure of the present invention essentially relies on the establishment of conditions which do not favour reverse reaction between the produced aluminium metal and carbon monoxide and for this reason seeks to reduce the active surface area of aluminium at which such reaction can take place by agglomerating as rapidly as possible the minute aluminium particles produced by reaction in the plasma.

The apparatus of the present invention therefore also preferably employs one or more supplementary devices or operations for accelerating solid or liquid particles towards the collection zone at the periphery of the plasma reactor. Thus the floor of the reactor preferably takes the form of a shallow cone, so that solid or liquid particles striking such floor are diverted towards the periphery. The electrical conditions in the lower region of the reactor are preferably arranged to favour the coalescence of solid and/or liquid particles. For this reason electrostatic precipitation devices may also be provided in this region to coalesce sub-micron size aluminium fume particles and other such particles and also to attract these coalesced particles towards the peripheral wall of the reactor so that they enter the bulk material collected at the wall region.

Any circulatory movement imparted to the falling particles by the plasma column assists in the separation and coalescence of solid and liquid particles from the produced gas in a manner somewhat analogous to the operation of a cyclone separator. This decreases the rate of back reaction in the zone below the tail flame region of the reactor.

Figure 2:
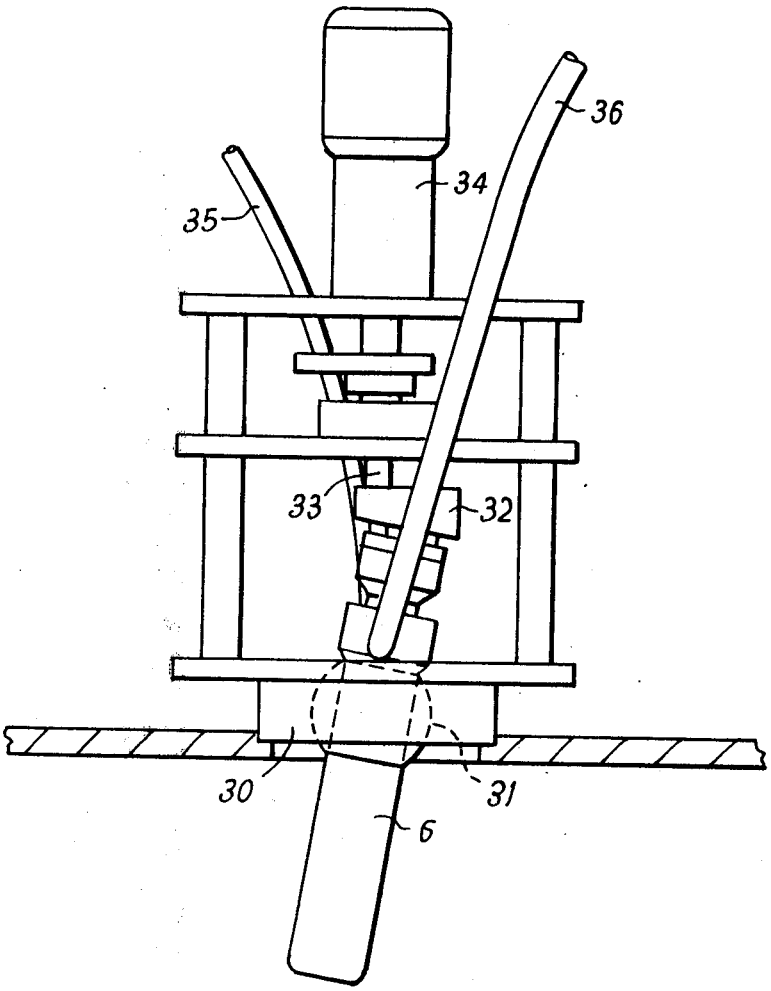
Figure 3:
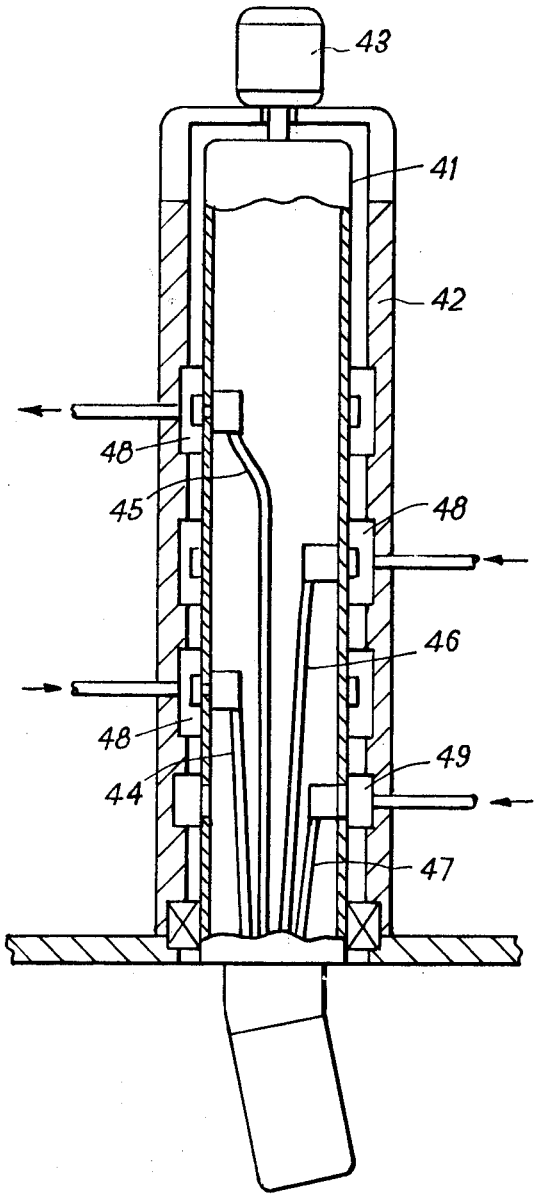
Figure 4:
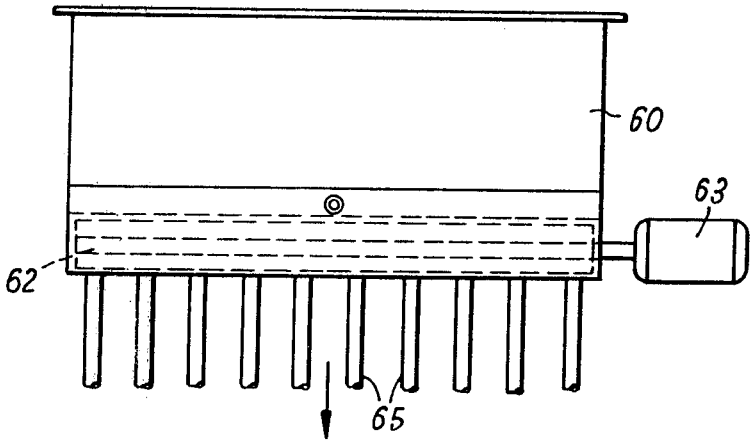
Figure 5:
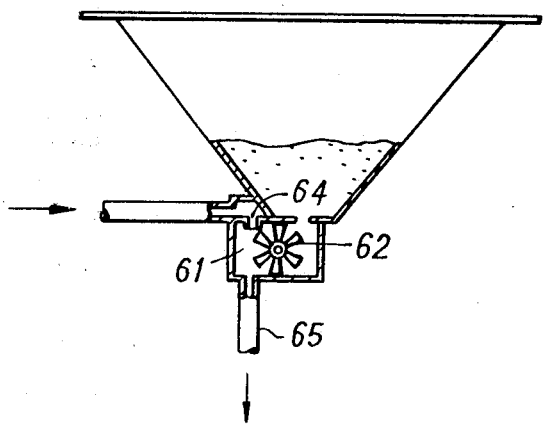
Figure 6:
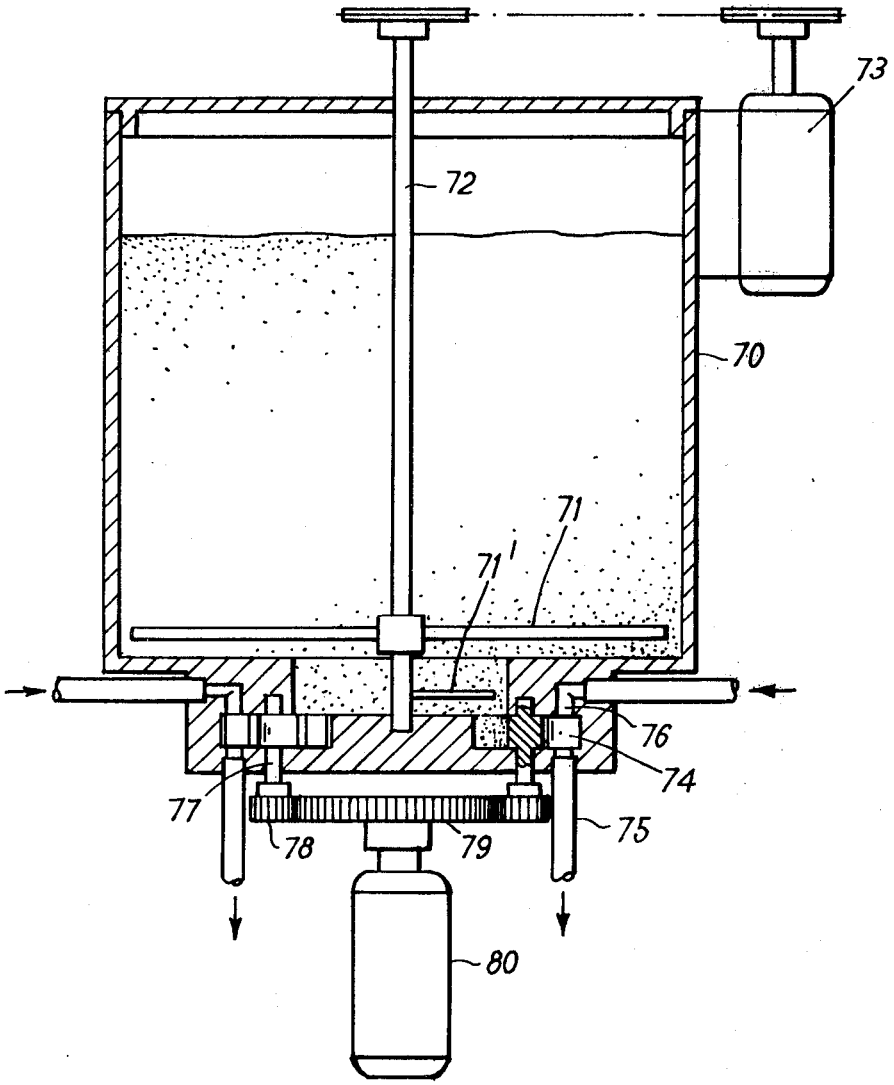
Figure 7:
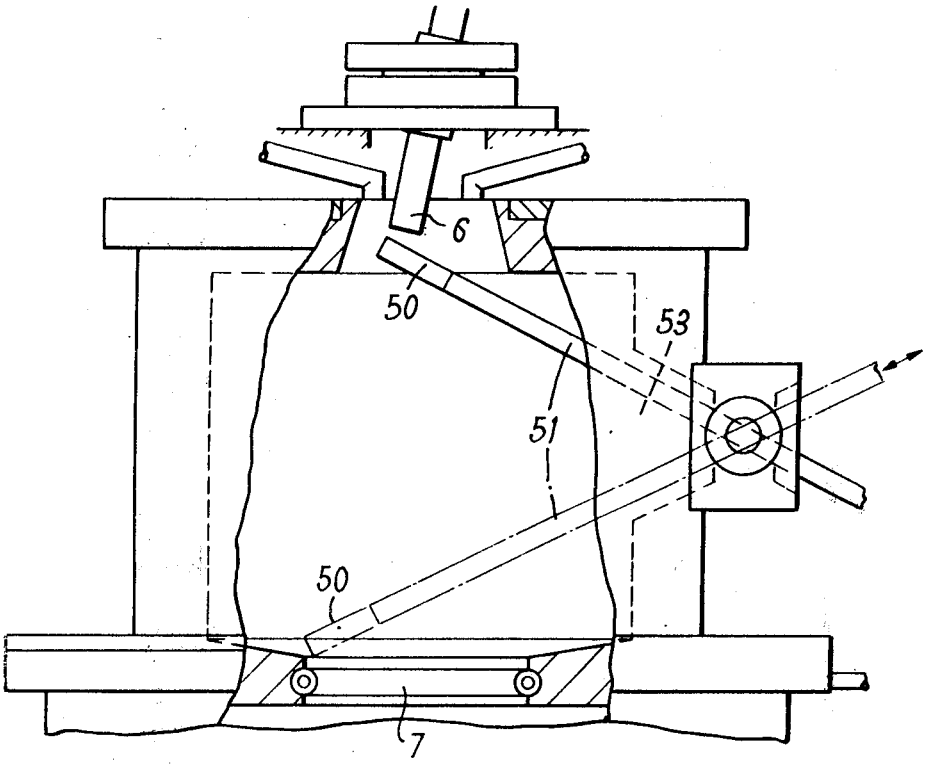
Figure 8:
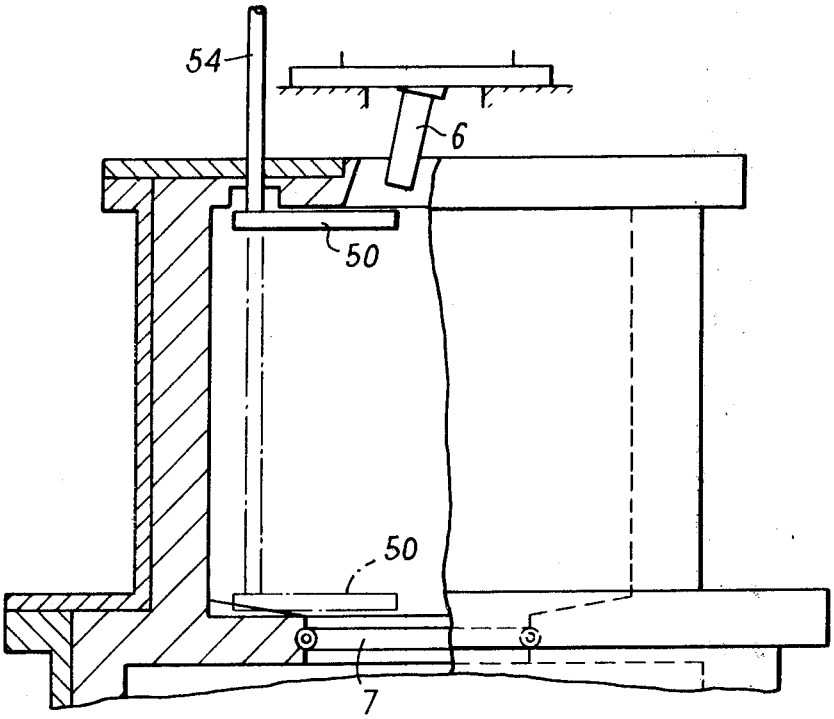
Figure 9:
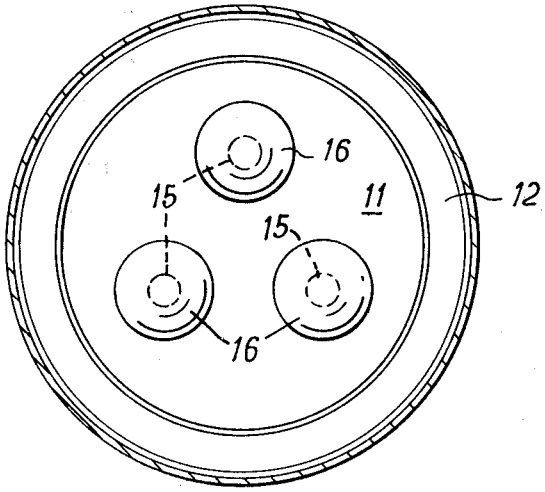
Figure 10:
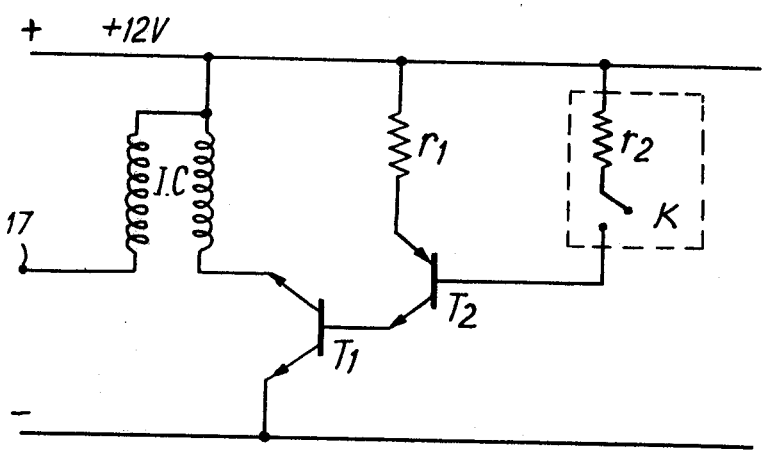
Figure 11:
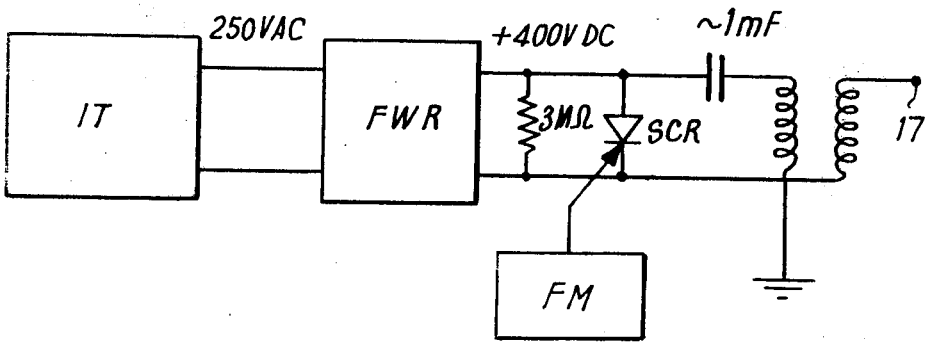

Referring now to the accompanying drawings:

FIG. 1 shows a diagrammatic vertical section of a plasma reactor,

FIG. 2 shows in greater detail one form of mounting of the plasma gun in the reactor of FIG. 1, FIG. 3 shows an alternative form of mounting the plasma gun, FIGS. 4 and 5 show respectively a side view and section of a multi-point feed system for a free flowing feed material, FIG. 6 shows a vertical section of a system for multi-point feed of fine powder materials, FIGS. 7 and 8 show two alternative systems for starting the plasma column between the plasma gun and the stationary electrode, FIG. 9 is a plan view of an alternative arrangement of the reactor floor showing multiple gas outlets, FIG. 10 shows a circuit for applying high voltage pulses to electrodes in the collection region of the reactor, and FIG. 11 shows an alternative circuit for the same purpose.

FIG. 1 shows diagrammatically a plasma reactor for the carbothermal reduction of very stable oxides such as alumina. The upper part of the reactor is essentially the same as that already described in our U.S. Pat. No. Re. 28,570.

At the top entrance to the reactor the rotor body 1, which is driven by a transmission belt or similar device 2, is mounted in bearings 3, in a stator body 4. The stator body 4 may be suspended independently as shown in FIG. 1, or alternatively, mounted upon the body of the furnace proper.

One or more plasma guns 6 of the constricted arc type are mounted in the rotor body 1. The gun or guns 6 may be slidably mounted in bearings 5, but this is unnecessary where starting devices of the type shown in FIGS. 7 and 8 are employed. As the service ducts supplying the gun 6 (which are not shown for simplicity) are prevented from twisting, the gun 6 is prevented from rotation about its own longitudinal axis but is merely allowed to orbit as a result of the rotation of the rotor body 1. The gun 6, if mounted slidably in bearings 5, is moved upward or downward by means of an electro-pneumatic or similar actuating mechanism (also not shown). By virtue of the above arrangement the plasma gun 6 may be given an orbiting motion which since the gun's axis is inclined to the vertical, will describe a latus rectum of a cone. The axis of the gun 6 points approximately downwards towards the inner periphery of a ring-shaped electrode 7 acting as an anode, to which the plasma column is transferred and from which a series of anode streamers are ejected to form a characteristic tail flame. This annular electrode 7 is cooled by internal circulation of a suitable coolant such as oil. Alternatively the counter-electrode may be a graphite ring, in which case the cooling is unnecessary. It is found that the surface of the graphite becomes coated with a glass-like protective layer in the course of operation.

Surrounding the plasma gun 6 is an annular opening 8, used for the introduction of feed materials. The feed material is preferably introduced so as to form a substantially uniform cylindrical curtain which enters and becomes entrained in the plasma column at a level close to that of the plasma gun. Alternatively an array of feed tubes may be placed symmetrically about the vertical axis of the reactor. Feed material may be supplied to such tubes by means of the two forms of feed system illustrated in FIGS. 4 to 6, according to the nature of the feed material.

The reactor comprises two chambers, the upper chamber 9 in which the precessing plasma column develops between the plasma gun 6 and the counter-electrode 7, and the lower chamber 10, enclosing the space between the annular electrode 7 and the furnace floor or bottom 11. The chamber 10 encloses a tail flame region immediately below the electrode 7 and a somewhat toroidal separation region into which coalesced liquid and/or solid particles are projected by the rotational movement imparted by the precessing plasma column.

The somewhat conical bottom 11 is specially adapted to assist the recovery of the products of carbothermal reduction in plasma of highly stable oxides. This directs solid or liquid materials towards an annular trough 12 in which the bulk material is relatively protected from back reaction with carbon dioxide in the chamber 10. A tap hole 13 is also provided and additional cooling of the circumferential trough 12 by gaseous or liquid coolants circulating in the spaces 14 may also be necessary to reduce the reactivity of the collected material. The central part of the bottom 11 is arched to facilitate the collection of the liquid product and to accelerate the liquid particles towards the periphery. At its centre there is a cooled gas exhaust duct 15 protected by a cowling or shield 16. By adopting the above design the spiralling droplets of product are thrown centrifugally outward towards the trough 12, while the gaseous product escapes through the duct 15. Preferably the evacuation of gases is assisted by applying an exhaust pump to the exhaust duct. In addition to the escape duct, safety plugs (not shown) are provided to blow out at a predetermined pressure to protect the reactor against the effects of possible blockage of the escape duct 15.

As the carbothermal reduction reactions take place as a rule at temperatures at which there is already a considerable vapour pressure exerted by the reduced metals, the losses due to fuming may be considerable and accordingly provisions may be made to minimise such losses by injecting a small quantity of powdered (or liquid spray) material into the lower furnace chamber by means (not shown) to act as nucleii for the coalescence of condensed metal vapour particles and also to accelerate the chilling of the reaction products as they pass through critical temperature ranges within which undesirable reverse reactions may occur.

The added material must obviously be either capable of separation from the liquid product or be unobjectionable in the final product. For this reason for the production of aluminium, aluminium powder is the preferred material, but it is also possible to contemplate the use of very small quantities of finely divided Fe, Si or $TiB_2$. However, powdered Al or sprayed liquid Al may be introduced in much larger quantity, for example, up to 50% or more of the produced aluminium may be recycled in this way. Where liquid droplets or solid particles are introduced by spraying it is preferred that it should be effected by means of a number of nozzles arranged so as to increase rotational movement of the atmosphere in the region 10. Such nozzles would be in approximately the position of the electrodes 17 in FIG. 1. The illustrated high tension electrodes 17 are an alternative or additional means for reducing the effects of fuming as explained more fully below.

Another important design feature lies in the ability to isolate the furnace chambers 9 and 10 as well as the various layers of refractories and insulations 18 and 19 respectively from the ambient atmosphere by providing a gas-tight outer steel shell 20. It should be mentioned that in operation, the plasma gun 6 will be supplied with a small quantity of an inert or reducing gas (or a mixture thereof) while the solid feedstocks will be also entrained in such gases. The inert gas, such as argon, further serves to dilute the produced carbon monoxide and thus helps to promote the process.

In the foregoing description the mounting of the plasma gun is indicated diagrammatically. FIG. 2 shows a mounting for a plasma gun which does not rotate about its own axis. The gun 6 is mounted in a support 30 in a ball mounting 31. The gun 6 is connected by a crank plate 32 to the shaft 33 of a hydraulic motor drive unit 34 which has a variable speed of up to 4000 r.p.m. The electrical lead 35 and gas and coolant lead 36 for the plasma gun enter it close to the ball mounting 31 and in consequence these leads have very small movements and only produce very small out-of-balance forces.

In the alternative arrangement shown in FIG. 3 the plasma gun is connected to the bottom end of a rotatable vertical drive tube 41, which is mounted for rotation within a stationary outer column 42. A hydraulic motor 43 is supported by column 42 and provides the drive for tube 41. Cooling water is led into and away from the plasma gun via tubes 44, 45, the gas supply for the plasma gun is brought in through a tube 46 and electric supply via a cable 47. Each of the tubes 44, 45 communicates with a related rotary seal 48 arranged between the rotating tube 41 and stationary column 42 and the cable 47 co-operates with a similarly arranged slip ring 49. The advantage of this arrangement is that no out-of-balance forces are induced during rotation and consequently it is possible to rotate the plasma gun 6 at even greater speeds than in the case of the apparatus of FIG. 2, in which slight out-of-balance forces occur through flexure of the leads 35, 36. The increase in rotational velocity that can be achieved is very advantageous in all processes involving the treatment of solid or liquid particles because it increases the number of occasions in which a falling particle contacts or enters the precessing plasma column in the course of its descent. This can be still further increased in the illustrated arrangement by supporting two or more plasma guns on the drive tube 41.

In the two plasma gun mounting systems illustrated in FIGS. 2 and 3 the plasma gun 6 is not movable longitudinally in relation to its axis. It is therefore necessary to provide an auxiliary mechanism for transferring the plasma column from the plasma gun to the counter-electrode at start-up.

At start-up orbital movement of the plasma gun about the vertical axis of the reactor has not yet been commenced. In the arrangement of FIG. 7 the plasma column is initially established between the plasma gun 6 and a movable shoe 50 which acts as an auxiliary counter-electrode and is supported on a lever 51, which is pivoted on movable external support structure (not shown) and which projects inwardly through an aperture 53 in the reactor wall. By pivotal movement of the lever 51 and longitudinal movement of its support structure the shoe 50 may be moved from the full line position in proximity to the gun 6 to the dotted line position in proximity to the counter-electrode 7. This permits the plasma column to be transferred from the plasma gun to the counter-electrode 7. The shoe 50 is then de-energised and withdrawn from the reactor. The aperture 53 in the reactor wall is then closed by insertion of an external plug.

In using the system illustrated in FIG. 7 initially a non-transferred arc is initiated in the plasma gun and is transferred to the shoe 50, which is initially positioned at approximately 6 cms from the plasma gun, by switching in the shoe as a counter-electrode.

In the alternative system illustrated in FIG. 8 the operating principle is the same as in FIG. 7. In the arrangement of FIG. 8 the shoe 50 is supported by a rod 54, which may be turned about its axis and which may be moved vertically. In this construction the shoe, during operation, is housed in the roof of the reactor. At start-up the rod 54 is lowered and then rotated to bring the shoe 50 to the start position beneath the plasma gun 6. The shoe is then switched in at the appropriate interval after establishment of the non-transferred arc and is lowered to the dotted-line position to transfer the plasma column to the counter-electrode 7. The shoe 50 is then switched out; the rod 54 is rotated to remove the shoe from the plasma column and the shoe is lifted to its retracted position in the reactor roof.

In both cases the orbiting movement of the plasma gun is started up as soon as the shoe 50 has been removed.

In the operation of the plasma furnace for the reduction of alumina or other oxides, the feed material is in the form of fine particles, composed of an intimate mixture of the oxide with carbon. The rate of feed and particle size of the feed material is matched to the power input of the plasma reactor and other plasma parameters to ensure that the particles are heated very rapidly to the reaction temperatures. The feed material is preferably fed in the form of a complete cylindrical curtain into the expanded plasma column so that the particulate material lies in a layer at the periphery of the plasma column and to some extent acts as a reflector for the plasma column energy.

The establishment of a complete cylindrical curtain of particulate material at the top of the reactor is however subject to a number of practical difficulties and it is found to be satisfactory in most instances to feed in the particulate material through multiple feeding ducts arranged around the axis of the reactor. As the particles descend they acquire different angular velocities, according to their size, as a result of contact with the precessing plasma column.

FIGS. 4 and 5 show a relatively simple hopper system for feeding a free flowing feed material to the reactor. The apparatus comprises a hopper 60, from which material is withdrawn and supplied to a feed duct 61 by means of an impeller 62, driven by a variable speed motor 63. A metered supply of gas under pressure is fed into the feed duct 61 through a restrictor 64 and the feed material is impelled into and through feed tubes 65 by the pressurised gas. Each tube 65 leads to a corresponding duct opening 8 (FIG. 1) in the reactor. By rotation of the impeller (which acts as a gas seal between the duct 61 and hopper 60) at an appropriate speed the feed material may be withdrawn from the hopper and blown into the reactor. Appropriate positioning of the duct openings 8 may be used to impart a spiralling movement to the feed particles entering the reactor.

The alternative feed arrangement illustrated in FIG. 6 is employed to overcome the packing problems experienced in feeding fine powders from a hopper.

In this arrangement the powdered feed material is held in a cylindrical hopper 70 and is agitated by shear blades 71 and 71' mounted on the lower end of a shaft 72, rotated by a belt drive from a stirrer drive motor 73.

The blades 71 and 71' prevent bridging and packing of the powder material in the lower part of the hopper, so as to permit entry into pockets in the periphery of feed rotor members 74. As the rotor members 74 turn, each pocket carries a measured quantity of powder material into a position in which it registers with a feed pipe 75, which is in register with a gas supply port 76, so that the measured quantity of powder is propelled to a corresponding inlet duct in the reactor. Each rotor member thus serves as a seal between the propulsion gas and the hopper. The rotor members 74 are mounted on shafts 77, which carry gears 78 in mesh with a sun gear 79, driven by a variable speed motor 80. As in the system of FIGS. 4 and 5, the powder material from the hopper enters the reactor at a plurality of positions spaced about the vertical axis.

FIG. 9 illustrates an alternative arrangement of the gas outlet system from the reactor. In this case, the reactor floor, here seen in plan, is provided with three gas outlets 15 arranged symmetrically about its centre and protected by a cowl 16, shaped to divert material outwardly towards the collector trough 12. This multiple gas outlet arrangement permits more efficient cooling of the gas outlets in relation to the total volume of gas generated in the reactor. Provided that there is adequate spacing of the ducts from the trough 12 (as shown in FIG. 9) the off-centre location of the inlets to the ducts 15 has little adverse effect on the separation of the gas from metal droplets and other solid or liquid particles in the lower chamber 10.

As already stated, auxiliary high tension electrodes 17 may be incorporated in the apparatus of FIG. 1. The purpose of these electrodes is to increase the recovery of the metal and possibly also other solids entrained in the gaseous effluents from the plasma zone, as well as to assist in condensation and coalescence of dispersed solid and liquid particles. This feature of the apparatus is an auxiliary, which in some circumstances may have substantial importance in increasing the recovery of product and increasing the efficiency of the process.

In the carbothermal reduction of alumina, the objectives of using the high tension electrodes is firstly, to coalesce liquid droplets and thus reduce the loss of aluminium carried out as fume in the gaseous effluent; and secondly to draw the coalesced droplets into the trough 12 where by reason of its reduced surface area the rate of back reaction with carbon monoxide is greatly reduced.

Applying a high voltage to an electrode situated as shown in FIG. 1, is not in itself sufficient, since the conditions in the reactor may vary from those of short circuit to those of relatively slow leakage. It is therefore necessary to apply a train of high voltage pulses to the electrodes 17. It is desirable that both frequency and the mark-space ratio may be adjusted to suit the process conditions.

Such pulses may be produced by employing a circuit as shown in FIG. 10. The circuit employs a high tension coil IC. The high tension secondary of the coil is connected to the probe electrode (electrode 17) while the primary is energised by an emitter-follower circuit.

The circuit as shown in FIG. 10 is used to switch the current to the primary of the coil. Transistor $T_1$ because of its low gain (approximately 5 in this case) necessitates an emitter-follower circuit (in which $T_1$ is the emitter-follower of transistor $T_2$). In experimental tests 600 mA was applied to the collector of $T_2$ and appeared as base current activating $T_1$, which was chosen to have a breakdown voltage greater than the back e.m.f. of the primary coil.

The resistor $r_2$ and the key K, in FIG. 10, represent a suitable free-running stable circuit, the frequency of which, as well as the mark-space ratio, is capable of adjustment to suit the experimental conditions. The reactor shown in FIG. 1 may be equipped with a number of such high tension probe electrodes 17. The high tension probe electrodes described above may be used alone to promote condensation and coalescence of metal droplets or in conjunction with, for instance, injection of a spray of relatively coarse droplets of cooled molten metal.

The arrangement shown in FIG. 10 is given by way of example; other means for applying high voltage pulses to probe electrodes may also be employed. For instance (see FIG. 11), a high tension coil (or a similar device) could be operated at even higher output voltages by means of an inverter transformer IT feeding into a full wave rectifier FWR which in turn energises an oscillating circuit comprising a capacitor, primary coil of the high tension coil and a silicon controlled rectifier (thyristor) SCR, fired by firing module FM. By triggering the thyristor with a suitable firing circuit, relatively high output pulses could be delivered to the primary of the high tension coil. The advantage of the circuit shown in FIG. 11 lies chiefly in the possibility of scaling-up the installation and utilising the intrinsic properties of an inverter transformer, namely that such transformers are protected from ill effects of short circuiting by the rise of frequency. A further advantage of the circuit shown in FIG. 11 is a much sharper output pulse edge. Furthermore, as the frequency is increased the associated voltage drop is much smaller than in the case of the circuit shown in FIG. 10.

In addition to the employment of high voltage electrodes within the reactor, additional high voltage electrodes may be employed in the gas passages carrying the evolved gases away from the reactor. These additional high voltage electrodes, (not shown), collect any aluminium condensing in the gas emitted from the reactor or very fine liquid droplets carried over in the gas.

I claim:

1. A plasma reactor comprising an upper chamber, at least one plasma gun arranged at the upper end thereof, means for moving said plasma gun in a circular orbit about the vertical axis of said upper chamber, a ring shaped counter-electrode at the lower end of said upper chamber, the internal diameter of said counter-electrode being greater than the diameter of the orbit of the plasma gun, means for introducing solid process feed materials into the upper end of the upper chamber and positioned to direct material into the zone between the counter-electrode and the plasma gun, the reactor further comprising a lower collection chamber beneath the counter-electrode, said collection chamber including a floor and side walls, and having a collection trough extending around the periphery of the floor adjacent the side walls, positioned to receive and collect particles entering the collection chamber, which particles have been moved radially outwardly into said trough by virtue of an angular acceleration imparted by the action of the plasma gun on the feed materials and wherein the floor of the separation chamber is shaped to direct impinging particles in the direction of the collection trough, and at least one gas outlet duct provided in a central region of said floor to lead gas, not subject to said angular acceleration, downwardly out of said collection chamber whereby the collection chamber acts in the manner of a cyclone separator to separate evolved gases from liquids and solids.

2. A plasma reactor according to claim 1 further including an upwardly convex cowling over the entrance to each gas outlet duct.

3. A plasma reactor according to claim 1 further including means for spraying liquid metal into said lower collection chamber directed to coalesce liquid droplets suspended within said chamber.

4. A plasma reactor according to claim 1 further including high voltage electrodes exposed to the atmosphere within said lower collection chamber and located in the region of the side walls of said collection chamber to assist movement of suspended particles towards the peripheral side walls.

5. A plasma reactor according to claim 1 further characterised in that one or more plasma guns are mounted in an inclined position at the lower end of a rotatable tube on the vertical axis of the plasma reactor, said gun receiving supplies of gas and coolant via rotary seals arranged between the rotatable tube and a surrounding stationary support structure whereby to impart a high rotational velocity to descending solid or liquid particles before entry to the collection chamber.

* * * * *